US008719983B2

(12) United States Patent
Nash

(10) Patent No.: US 8,719,983 B2
(45) Date of Patent: May 13, 2014

(54) INFLATABLE BODY CONTOUR SUPPORT CUSHION

(76) Inventor: Leigh Anne Nash, Buford, GA (US)

( * ) Notice: Subject to any disclaimer, the term of this patent is extended or adjusted under 35 U.S.C. 154(b) by 0 days.

(21) Appl. No.: 13/311,422

(22) Filed: Dec. 5, 2011

(65) Prior Publication Data

US 2012/0144594 A1 Jun. 14, 2012

Related U.S. Application Data

(60) Provisional application No. 61/421,728, filed on Dec. 10, 2010.

(51) Int. Cl.
*A47C 27/08* (2006.01)
*A47G 9/10* (2006.01)

(52) U.S. Cl.
USPC ..... 5/655.3; 5/648; 5/630; 5/652

(58) Field of Classification Search
USPC ..... 5/655.3, 654, 644, 490, 737, 648, 706, 5/615, 715, 709, 630, 652
See application file for complete search history.

(56) References Cited

U.S. PATENT DOCUMENTS

| | | | | |
|---|---|---|---|---|
| 4,914,762 | A * | 4/1990 | Perali et al. | 5/655.3 |
| 5,003,653 | A * | 4/1991 | Mar | 5/654 |
| 5,173,979 | A * | 12/1992 | Nennhaus | 5/648 |
| 5,809,597 | A * | 9/1998 | Shaw | 5/655.3 |
| 6,047,425 | A * | 4/2000 | Khazaal | 5/644 |
| 6,131,219 | A * | 10/2000 | Roberts | 5/644 |
| 6,598,250 | B1 * | 7/2003 | Pekar | 5/654 |
| 7,048,703 | B2 * | 5/2006 | Riach | 602/13 |
| 7,296,313 | B2 * | 11/2007 | Hense | 5/648 |

* cited by examiner

*Primary Examiner* — Michael Trettel
(74) *Attorney, Agent, or Firm* — Mark D. Trenner; Trenner Law Firm, LLC

(57) ABSTRACT

An inflatable body contour support cushion comprises a bladder comprising a flexible material. Said bladder is configured to retain a quantity of material to maintain said bladder in a flaccid state in which the material flows freely within said bladder. Said bladder is further configured to support a body contour by filling the space between the body contour and a surface against which the body contour is resting. A valve mechanism is configured to enable addition and removal of the material from said bladder in which a user can adjust a level of the support.

16 Claims, 5 Drawing Sheets

INFLATABLE BODY CONTOUR SUPPORT CUSHION

CROSS-REFERENCE TO RELATED APPLICATIONS

The present Utility patent application claims priority benefit of the U.S. provisional application for patent Ser. No. 61/421,728 entitled "An inflatable body contour support cushion", filed on Dec. 10, 2010 under 35 U.S.C. 119(e). The contents of this related provisional application are incorporated herein by reference for all purposes to the extent that such subject matter is not inconsistent herewith or limiting hereof.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to personal comfort aids. More particularly, one or more embodiments of the invention relate to a body contour support cushion.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon. It is believed that many activities such as, but not limited to, sitting in a chair, driving in a car, performing exercise, or lying down for rest may often result in discomfort due to poor support of the contours of the body.

By way of educational background, an aspect of the prior art generally useful to be aware of is that multiple inflatable back and neck support cushions are currently available. These support cushions are typically designed to be fully inflated. In addition, many of these body support cushions are generally not designed in sizes and shapes that provide enough adjustability to support a wide range of body contours on bodies of different shapes and sizes.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1A is a front perspective view of the cushion. FIG. 1B is a front perspective view of an inflatable bladder, and FIG. 1C is a front perspective view of the cushion in use on a chair.

Figure 1A:
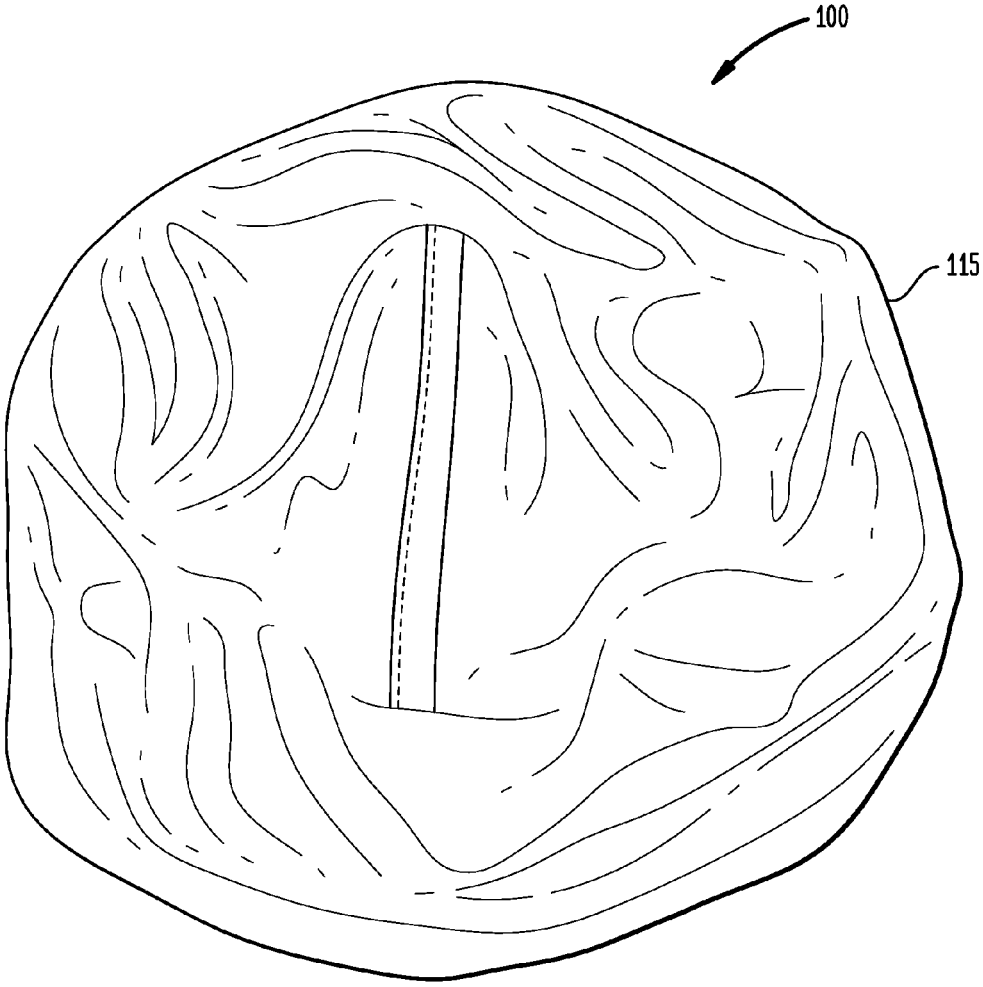
FIGS. 1A through 1C illustrate an exemplary inflatable body contour support cushion, in accordance with an embodiment of the present invention.

Unless otherwise indicated illustrations in the figures are not necessarily drawn to scale.

DETAILED DESCRIPTION OF SOME EMBODIMENTS

Embodiments of the present invention are best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

A practical embodiment of the present invention provides an inflatable body contour support cushion. Many embodiments are typically used to support body contours when sitting in a chair, lying in bed, or resting on various different surfaces. Many practical embodiments can be inflated with varying amounts of air to be adjusted to fill virtually any contour of the body against a surface, thus providing support for the body contour. The adjustability of these embodiments also enables the support cushion to be adjusted to support the contours of bodies of a wide range of shapes and sizes.

Figure 1B:
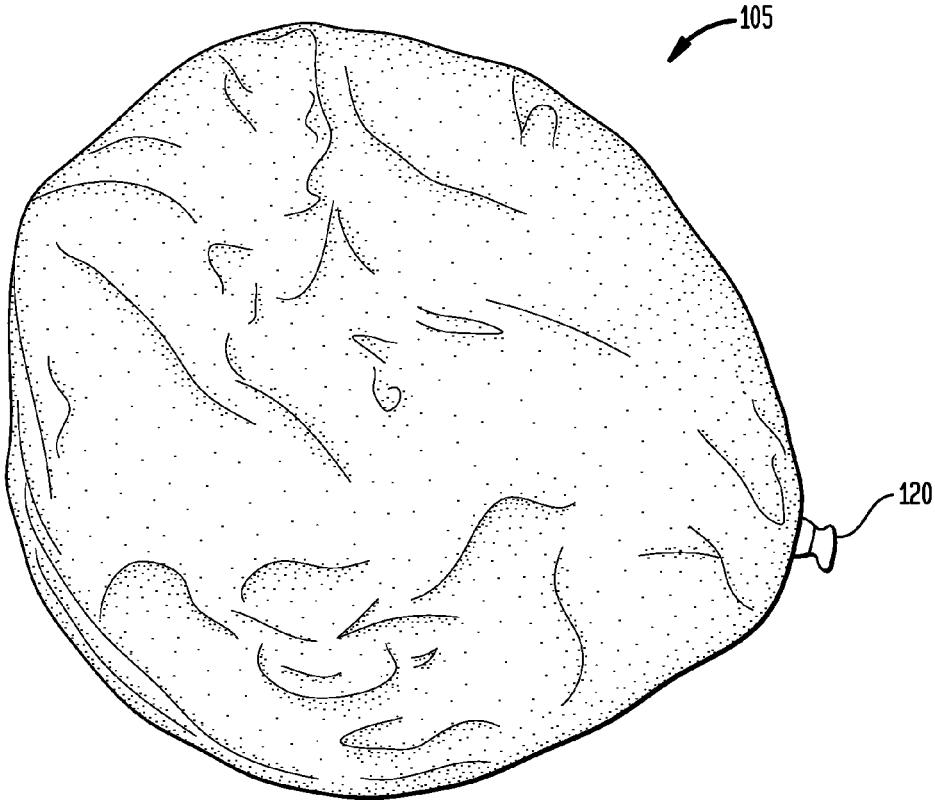
Figure 1C:
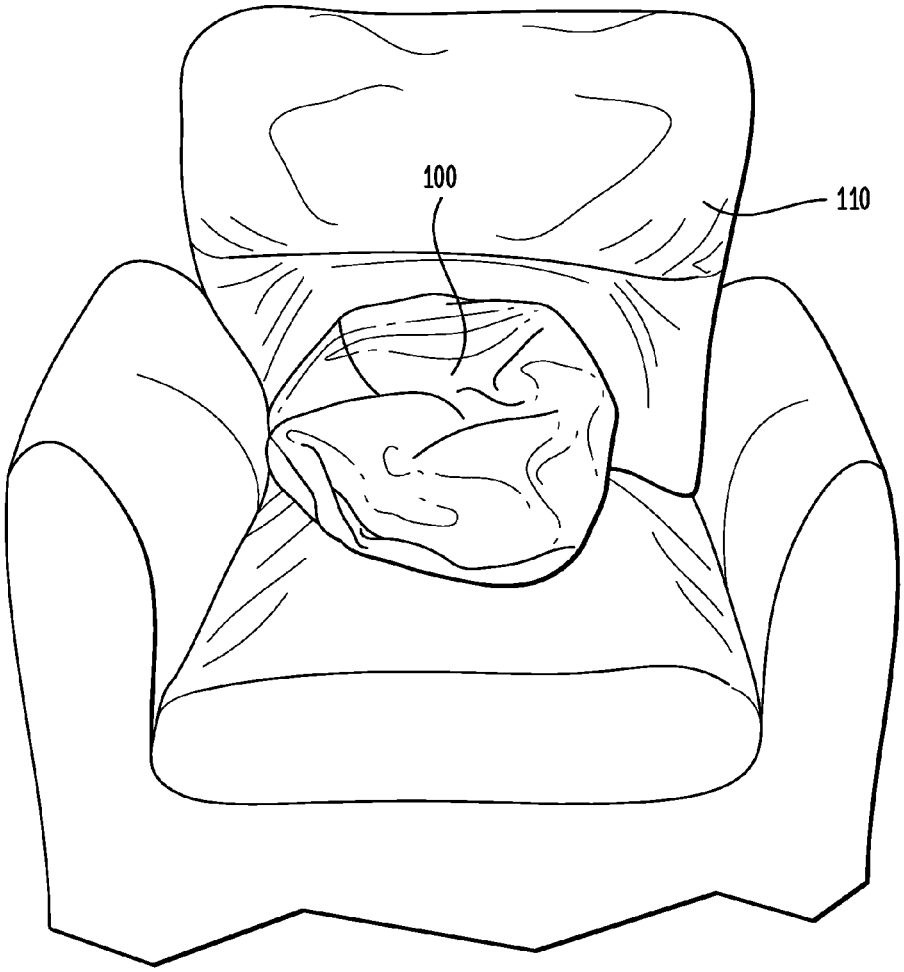

FIGS. 1A through 1C illustrate an exemplary inflatable body contour support cushion 100, in accordance with an embodiment of the present invention. FIG. 1A is a front perspective view of cushion 100. FIG. 1B is a front perspective view of an inflatable bladder 105, and FIG. 1C is a front perspective view of cushion 100 in use on a chair 110. In the present embodiment, cushion 100 comprises inflatable air bladder 105 and a cover 115. Referring to FIG. 1B, air bladder 105 is made of PVC material and, when fully inflated, is spherical in shape and approximately the size of a regulation basketball. It is contemplated that bladders in some alternate embodiments may be made of a multiplicity of suitable materials including, without limitation, various different plastics, rubber, silicone, latex, etc. In some alternate embodiments the air bladder may be designed to be fully inflated into various different shapes such as, but not limited to, an elliptical sphere shape, cylindrical shapes, rectangular pillow shapes, etc. Furthermore, the size of the air bladder in some alternate embodiments may be larger or smaller to accommodate different sizes of people or different types of body contours. In the present embodiment, air bladder 105 comprises a valve 120 with which a user may inflate air bladder 105 using his mouth or a pump. In some alternate embodiments, the air bladder may comprise a different type of inflation mechanism such as, but not limited to, a built-in mechanical pump device or an electric pump for ease of inflation.

Referring to FIG. 1A, air bladder 105 is encased within cover 115, which is removable. Cover 115 is made of a flexible material such as, but not limited to, fabric, faux leather, genuine leather, vinyl, or other material. An opening (not shown) in cover 115 enables air bladder 105 to be inserted into cover 115 while bladder 105 is in a deflated state. Cover 115 may comprise various different types of closure means at this opening for example, without limitation, hook and loop material, zippers, snaps, buttons, etc. In some alternate embodiments, the bladder may be permanently encased by the cover. Other alternate embodiments may be implemented without a cover.

In typical use of the present embodiment, air bladder 105 is placed inside cover 115 in a deflated state then inflated as desired to support a user's body contour against a surface. Air bladder 105 is typically utilized in a mostly deflated, flaccid state, thus allowing the air inside bladder 105 to flow smoothly into the void of the body contour when bladder 105 becomes pressurized by body weight. Air bladder 105 is generally inflated to between 10-50% of its potential volume. Cushion 100 generally provides proper support when used in a mostly deflated state. The use of a mostly deflated air bladder 105, as opposed to an air bladder designed to be fully inflated to fit the size of a particular body contour, as is typical in current inflatable body support cushions, provides adjustable means for achieving support of a body contour by accurately filling the space between the body contour and a surface against which the body contour is resting, for example, without limitation, chair 110 shown by way of example in FIG. 1C, generally without leaving extra space or occupying too much space. The ability to change the amount of air inside bladder 105 also enables cushion 100 to support body contours of various different shapes and sizes.

Figure 2:
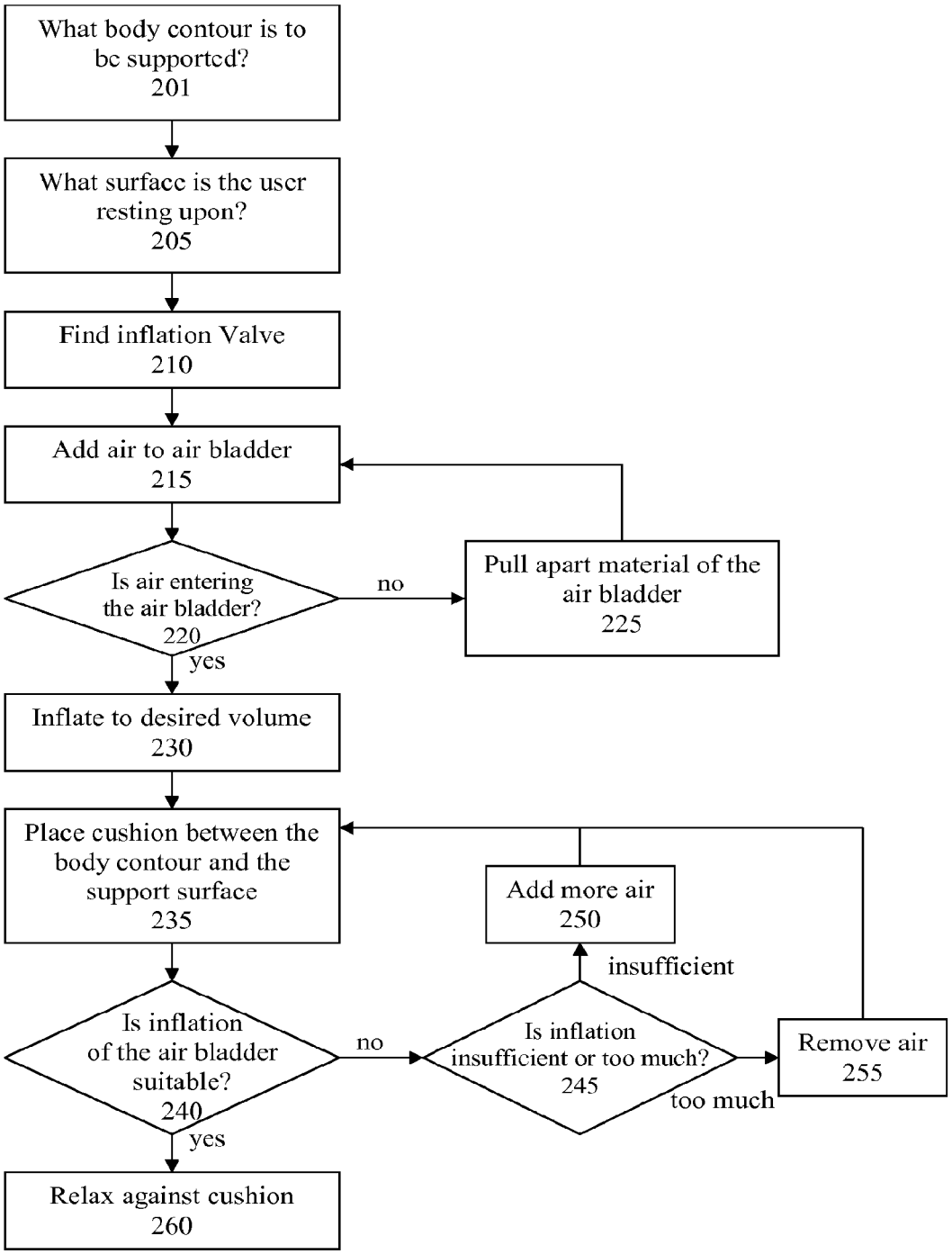
FIGS. 2 and 3 are flowcharts illustrating example methods.

FIG. 2 is a flowchart illustrating an exemplary method of use for a body contour support cushion, in accordance with an embodiment of the present invention. In typical use of the present embodiment, in step 201 a user chooses what body contour he would like to support with the cushion, such as, but not limited to, the lumbar spinal curve, the cervical spinal curve, a lateral spinal curve, the knees, the arms, etc. The user then determines what type of surface against which he would like to sit or lie in step 205, for example, without limitation, a chair, a sofa, a car seat, a bed, the floor, a wall, etc. The amount of air added to an air bladder within the support cushion is based upon the size of the body contour being supported and the type of resting surface among other factors such as, but not limited to, user preference. Very little air is typically required within the air bladder to achieve suitable support, and the cushion is typically used in a mostly deflated state. Generally, if the user is resting against a firm surface, approximately 1-2 full breaths of air within the air bladder enables the cushion to properly support the body contour, and if the user is resting against a softer surface, approximately 3-4 full breaths within the air bladder typically enables the cushion to properly support the body contour. To inflate the support cushion, the user finds an inflation valve on the air bladder in step 210 by releasing any closure means such as, but not limited to, hook and loop material, snaps or a zipper at an opening on a fabric cover encasing the air bladder. The air bladder is typically not removed from the fabric cover for inflation. Next, in step 215, the user adds air to the air bladder by lightly pinching the base of the inflation valve and blowing air into the valve or pumping air into the valve with a mechanical pump device. The user determines if air is entering the air bladder through the valve in step 220. If the user is initially having difficulty getting air through the valve, the user may gently pull the material of the air bladder apart near the base of the valve and return to step 215 to reattempt inflation. If air is entering the valve in step 220, the user continues to add air to the air bladder until the desired volume of air is achieved in step 230. For example, without limitation, if inflating by mouth, the user may begin by blowing 1-2 full breaths of air into the inflation valve if resting upon a firm surface or 3-4 full breaths if resting upon a softer surface. Next, in step 235, the user places the support cushion in the body contour to be supported and against the surface with which the body is in contact. For example, without limitation, the user may place the cushion between the small of his back and the backrest of a chair or car seat. In step 240, the user determines if the amount of air in the air bladder is providing suitable support. If the inflation is not suitable, the user determines in step 245 if the inflation is insufficient or too much. If it is determined that the inflation is not sufficient to properly support the body contour in step 245, the user adds more air to the air bladder in step 250. If the inflation is more than desired for support of the body contour, air is released from the air bladder through the valve in step 255. Once the user removes air from or adds air to the air bladder, the user returns to steps 235 and 240 by placing the cushion in the body contour and determining if the inflation is suitable. Once the inflation of the air bladder is sufficient to provide support and comfort to the user, the user can relax against the cushion with his body contour supported in step 260.

Figure 3:
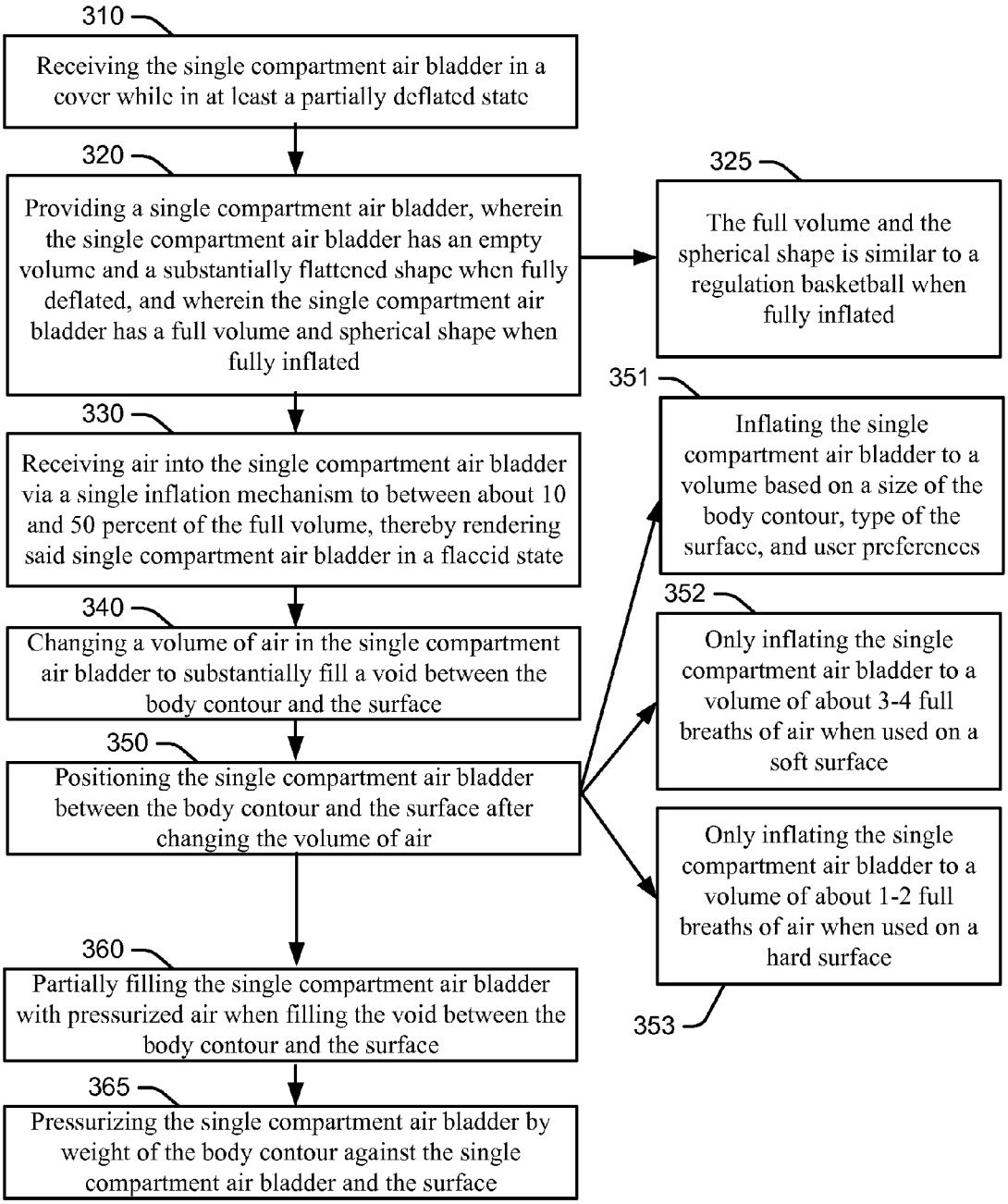

FIG. 3 illustrates another example method. For example, the method may be of supporting a body contour against a surface upon which the body contour is resting against. Or the method may be of supporting knees of a user while the user lies in a side lying position.

In step 310, a single compartment air bladder is received in a cover while in at least a partially deflated state. In step 320, a single compartment air bladder is provided, wherein the single compartment air bladder has an empty volume and a substantially flattened shape when fully deflated, and wherein the single compartment air bladder has a full volume and spherical shape when fully inflated. In step 325, the full volume and the spherical shape is similar to a regulation basketball when fully inflated.

In step 330, air is received into the single compartment air bladder via a single inflation mechanism to between about 10 and 50 percent of the full volume, thereby rendering said single compartment air bladder in a flaccid state. In step 340, a volume of air in the single compartment air bladder is changed to substantially fill a void between the body contour and the surface. In step 350, the single compartment air bladder is positioned between the body contour and the surface after changing the volume of air.

In step 351, the single compartment air bladder is inflated to a volume based on a size of the body contour, type of the surface, and user preferences. In step 352, the single compartment air bladder is only filled to a volume of about 3-4 full breaths of air when used on a soft surface. In step 353, the single compartment air bladder is only filled to a volume of about 1-2 full breaths of air when used on a hard surface.

In step 360, the single compartment air bladder is partially filled with pressurized air when filling the void between the body contour and the surface. In step 365, the single compartment air bladder is pressurized by weight of the body contour against the single compartment air bladder and the surface.

It is noted that the method described with reference to FIG. 3 is only intended to be illustrative. Not all steps are required to be performed, and additional steps may also be added. Nor are the steps shown in any particular order, and rearranging the order of one or more of the steps is still considered to be within the scope of the claims.

Those skilled in the art will readily recognize, in light of and in accordance with the teachings of the present invention, that many embodiments may be used in a wide variety of situations. For example, without limitation, a body contour support cushion may be used in the curve of a user's lower back while the user is sitting in an office chair, in a sofa, in a car seat, in an airplane seat, etc. A body contour support cushion may also be used in the curve of the neck while the user is reclining on a sofa, in a bed, in the passenger's seat of a car, on an airplane, etc. Body contour support cushions may also be used with other portions of the body such as, but not limited to, under the heels while resting on an ottoman or coffee table, between the knees while lying on one side. A body contour support cushion according to an embodiment of the present invention can be used to effectively support many body contours on the same user when resting against a surface including, without limitation, the lumbar spinal lordosis, the cervical spinal lordosis, a lateral spinal curve, below the knee bend, under the arm, etc.

Many embodiments of the present invention provide support properties due to the minimal volume of air in the air bladder, which becomes pressurized by a user's unique body weight and contour when the user rests against the cushion. This type of support enables the cushion to be adjustable to fit a wide range of users and various different body contours. Inflatable body support cushions that are currently in use are typically designed to be inflated to such an extent that the air bladder is in a mostly inflated state when it is positioned in the body contour. Because the air inside the bladder of many practical embodiments is typically much less than the full potential volume of the bladder, the air can move inside the bladder as the user moves his body, providing support that generally follows the body's movement.

A basic embodiment of the present invention comprises an air bladder with an inflation valve and no cover. In embodiments that do comprise covers, these covers may be made in a variety of colors, patterns and designs to suit a user's preference or to match a décor. It is contemplated that some alternate embodiments may be implemented with a multiplicity of suitable features such as, but not limited to, padded covers, electric warmers, vibrators, etc.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. Thus, the present invention is not limited to any particular tangible means of implementation.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Having fully described at least one embodiment of the present invention, other equivalent or alternative methods of providing a body contour support cushion according to the present invention will be apparent to those skilled in the art. The invention has been described above by way of illustration, and the specific embodiments disclosed are not intended to limit the invention to the particular forms disclosed. For example, the particular implementation of the bladder may vary depending upon the particular type of fill material used. The bladders described in the foregoing were directed to air filled implementations; however, similar techniques are to provide support cushions with interior bladders or compartments that may be filled with various different materials such as, but not limited to, water, sand, beads, foam pieces, etc. Non-air filled implementations of the present invention are contemplated as within the scope of the present invention. The invention is thus to cover all modifications, equivalents, and alternatives falling within the spirit and scope of the following claims.

Claim elements and steps herein may have been numbered and/or lettered solely as an aid in readability and understanding. Any such numbering and lettering in itself is not intended to and should not be taken to indicate the ordering of elements and/or steps in the claims.

What is claimed is:

1. A method of supporting a body contour against a surface upon which the body contour is resting against, comprising:

providing a single compartment air bladder, wherein the single compartment air bladder has an empty volume and a substantially flattened shape when fully deflated, and wherein the single compartment air bladder has a full volume and spherical shape when fully inflated;

receiving air into the single compartment air bladder via a single inflation mechanism to between about 10 and 50 percent of the full volume, thereby rendering said single compartment air bladder in a flaccid state; and changing a volume of air in the single compartment air bladder to substantially fill a void between the body contour and the surface.

2. The method of claim 1, further comprising positioning the single compartment air bladder between the body contour and the surface after changing the volume of air.

3. The method of claim 1, wherein the full volume and the spherical shape is similar to a regulation basketball when fully inflated.

4. The method of claim 1, wherein the single compartment air bladder is partially filled with pressurized air when filling the void between the body contour and the surface.

5. The method of claim 1, wherein the single compartment air bladder is pressurized by weight of the body contour against the single compartment air bladder and the surface.

6. The method of claim 1, further comprising receiving the single compartment air bladder in a cover while in at least a partially deflated state.

7. The method of claim 1, wherein the single compartment air bladder is inflated to a volume based on a size of the body contour, type of the surface, and user preferences.

8. The method of claim 1, further comprising only inflating the single compartment air bladder to a volume of about 1-2 full breaths of air when used on a hard surface.

9. The method of claim 1, further comprising only inflating the single compartment air bladder to a volume of about 3-4 full breaths of air when used on a soft surface.

10. A method of supporting knees of a user while the user lies in a side lying position, comprising:

providing a single compartment air bladder, wherein the single compartment air bladder has an empty volume and a substantially flattened shape when fully deflated, and wherein the single compartment air bladder has a full volume and spherical shape when fully inflated;

receiving air into the single compartment air bladder via a single inflation mechanism to between about 10 and 50 percent of the full volume, thereby rendering said single compartment air bladder in a flaccid state; and changing a volume of air in the single compartment air bladder to substantially fill a void between the knees of the user.

11. The method of claim 10, further comprising positioning the single compartment air bladder between the knees of the user.

12. The method of claim 10, wherein the full volume and the spherical shape is similar to a regulation basketball when fully inflated.

13. The method of claim 10, wherein the single compartment air bladder is partially filled with pressurized air when positioned between the knees of the user.

14. The method of claim 10, wherein the single compartment air bladder is pressurized by weight of a top leg of the user against the single compartment air bladder and a bottom leg of the user.

15. The method of claim 10, further comprising receiving the single compartment air bladder in a cover while in at least a partially deflated state.

16. The method of claim 10, wherein the single compartment air bladder is inflated to a volume that separates knees of the user to a distance desired by the user.

* * * * *